US006646605B2

(12) United States Patent
McKinzie, III et al.

(10) Patent No.: US 6,646,605 B2
(45) Date of Patent: Nov. 11, 2003

(54) TUNABLE REDUCED WEIGHT ARTIFICIAL DIELECTRIC ANTENNAS

(75) Inventors: William E. McKinzie, III, Fulton, MD (US); Steven L. Garrett, Mineral Wells, TX (US); James D. Lilly, Silver Spring, MD (US)

(73) Assignee: e-Tenna Corporation, Del Mar, CA (US)

( * ) Notice: Subject to any disclaimer, the term of this patent is extended or adjusted under 35 U.S.C. 154(b) by 0 days.

(21) Appl. No.: 09/976,441

(22) Filed: Oct. 12, 2001

(65) Prior Publication Data

US 2002/0057222 A1 May 16, 2002

Related U.S. Application Data

(60) Provisional application No. 60/240,524, filed on Oct. 12, 2000.

(51) Int. Cl.[7] ..... H01Q 1/36
(52) U.S. Cl. ..... 343/700 MS; 333/238
(58) Field of Search ..... 333/238, 161; 343/700 MS, 895, 911 R, 909, 910

(56) References Cited

U.S. PATENT DOCUMENTS 5,621,423 A 4/1997 Sureau ..... 343/909
6,075,485 A * 6/2000 Lilly et al. ..... 343/700 MS
6,307,519 B1 * 10/2001 Livingston et al. ..... 343/767
6,377,142 B1 * 4/2002 Chiu et al. ..... 333/238

FOREIGN PATENT DOCUMENTS

JP 11345518 12/1999
WO WO 00/24080 4/2000

* cited by examiner

*Primary Examiner*—James Clinger
(74) *Attorney, Agent, or Firm*—Pillsbury Winthrop LLP

(57) ABSTRACT

A tunable artificial dielectric material achieves the weight reductions made possible in U.S. Pat. No. 6,075,485 and further achieves even higher resonant frequency tuning ratios. In one embodiment of the invention, the artificial dielectric substrate for a patch antenna comprises alternating low and high permittivity layers, with the high permittivity layers each comprised of printed capacitive Frequency Selective Surface (FSS). An example FSS of the invention has a voltage tunable effective sheet capacitance by virtue of varactor diodes integrated into each unit cell. By appropriate adjustment of the bias voltage across the varactor diodes, the amount of the electric field stored in the substrate can be varied, which further varies the resonant frequency of the patch antenna.

20 Claims, 13 Drawing Sheets

FIG. 7
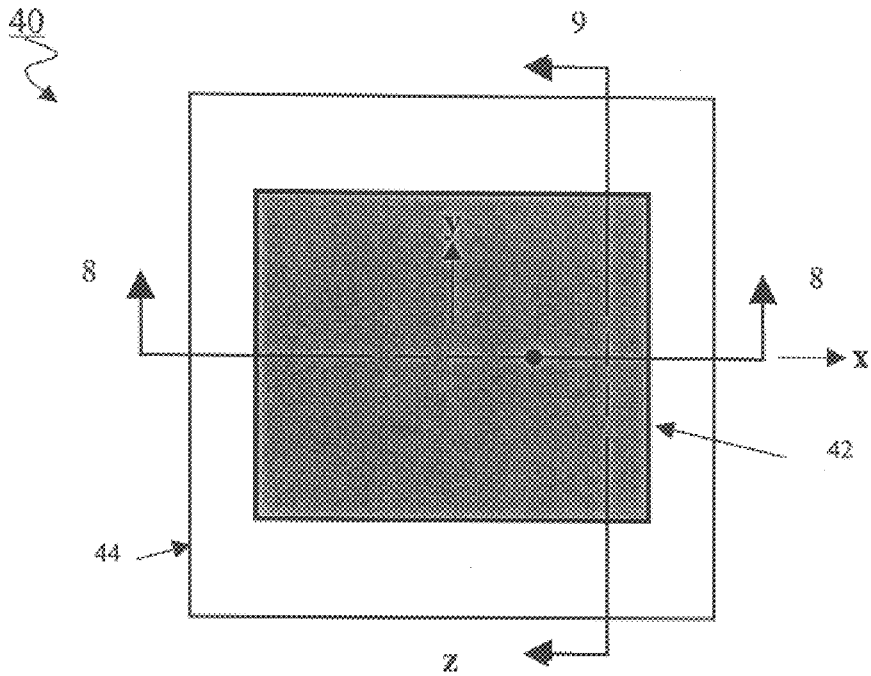
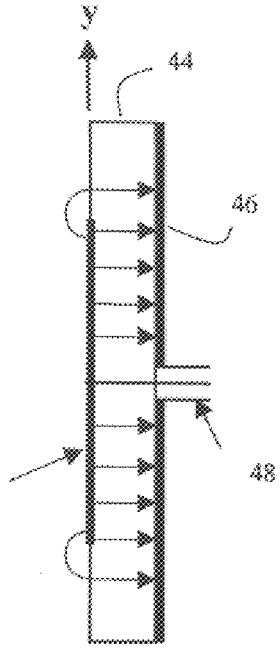
FIG. 8
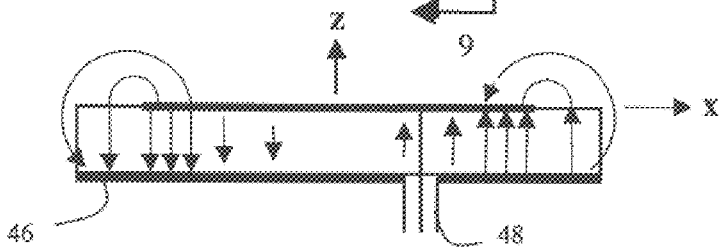
FIG. 9

TUNABLE REDUCED WEIGHT ARTIFICIAL DIELECTRIC ANTENNAS

CROSS REFERENCE TO RELATED APPLICATIONS

The present application is based on, and claims priority from, U.S. Prov. Appln. No. 60/240,524, filed Oct. 12, 2000, commonly owned by the assignee of the present application, the contents of which are incorporated herein by reference.

BACKGROUND OF THE INVENTION

1. Field of the Invention

The present invention relates to antennas and dielectric substrate materials therefor, and in particular, to a tunable microstrip antenna dielectric material that is capable of use in portable or mobile applications where minimal aperture size and weight are desired, and where high bandwidth is preferred.

2. Description of the Related Art

U.S. Pat. No. 6,075,485 to Lilly et al. entitled "Reduced Weight Artificial Dielectric Antennas and Method for Providing the Same" dramatically advanced the state of the art.

An artificial dielectric structure 10 according to U.S. Pat. No. 6,075,485 is shown in FIG. 1. It comprises a periodic structure or stack of alternating layers of high and low permittivity isotropic dielectric materials 12 and 14, having respective relative permittivities of $\in_{r1}$ and $\in_{r2}$. As shown in the drawing, layers 12 and 14 have respective thicknesses of $t_1$ and $t_2$, and the direction normal to the surface of the layers (i.e. the direction of stacking of the layers) is parallel with the Y axis. The number of alternating layers 12 and 14 used in the stack depends on their respective thicknesses and the overall size of the structure desired.

One of the merits of the structure of FIG. 1 is that tensor permittivities in the dielectric structure can be engineered to be any value between $\in_{r1}$ and $\in_{r2}$ by appropriate selection of the respective thicknesses for given respective permittivities of layers 12 and 14. The weight of the resulting structure 10 can be easily designed as well. In particular, a significant weight savings can be achieved by selecting a thin high permittivity dielectric material for layer 12 and a much thicker but very low weight dielectric material such as foam for layer 14.

Even greater weight savings can be achieved when the high permittivity dielectric material layer 12 is itself an artificial dielectric material, such as a frequency selective surface (FSS). For example, a 0.020" thick FSS can be designed to represent an equivalent capacitance of up to $\in_r$=800, while exhibiting a specific gravity of only about ~2.5 grams/cm$^3$, further improving the results obtained in the above example.

As shown in FIGS. 2 and 3, a frequency selective surface (FSS) 20 for possible use as a high permittivity dielectric material 12 in structure 10 is an electrically thin layer of engineered material (typically planar in shape) which is typically comprised of periodic metallic patches or traces 22 laminated within a dielectric material 24 for environmental protection.

The electromagnetic interaction of an FSS with plane waves may be understood using circuit analog models in which lumped circuit elements are placed in series or parallel arrangements on an infinite transmission line which models the plane wave propagation. FSS structures are said to be capacitive when their circuit analog is a single shunt capacitance. This shunt capacitance, C (or equivalent sheet capacitance), is measured in units of Farads per square area. Equivalently, the reactance presented by the capacitive FSS can be expressed in units of ohms per square area. This shunt capacitance is a valid model at low frequencies where $(\beta_1 t_1) \ll 1$, and $t_1$ is the FSS thickness. As a shunt capacitance, electromagnetic energy is stored by the electric fields between metal patches. Physical implementations of capacitive FSS structures usually contain periodic lattices of isolated metallic "islands" such as traces 22 upon which bound charges become separated with the application of an applied or incident electric field (an incident plane wave). The periods of this lattice are much less than a free space wavelength at frequencies where the capacitive model is valid. The equivalent relative dielectric constant of a capacitive FSS is given as $\in_r = C/(\in_0 t_1)$ where $\in_0$ is the permittivity of free space. FSS structures can be made with $\in_r$ values extending up to several hundred.

FIG. 2 is a top view of a conventional anisotropic FSS 20 comprised of square metal patches 22 where each patch is identical in size, and buried inside a dielectric layer 24 (such as FR-4). FIG. 3 is a cross-sectional side view of FIG. 2 taken along sectional line 3—3 of FIG. 2. As shown, the gaps between patches 22 are denoted as $g_x$ in the x direction and $g_z$ in the z direction. If these variables are different dimensions, as shown in this figure, then the equivalent capacitance provided by the FSS is different for electric fields polarized in the x and z directions. Since $g_x$ is smaller than $g_z$, the equivalent sheet capacitance for x-polarized E fields will be larger than for z-polarized E fields. For a given value of incident E field, more energy will be stored for the x polarized waves than for the z polarized waves. This leads to $\in_{rx} > \in_{rz}$ in the FSS, and $\in_x > \in_z$ in the equivalent bulk permittivity for a layered substrate when it is included in a non-homogeneous stacked dielectric substrate such as substrate 10 (assuming that the second layer is isotropic, such as foam).

FIGS. 4 through 6 illustrate a linearly-polarized patch antenna 40 according to U.S. Pat. No. 6,075,485. FIG. 4 is a top view, and FIGS. 5 and 6 are cross-sectional views taken along lines 5—5 and 6—6, respectively. As shown, antenna 40 includes a substrate comprised of artificial dielectric material 10, having alternating layers 12 and 14 of high and low permittivity dielectric materials, respectively, a microstrip patch 42, a coaxial feed 44 and a metalized ground plane 46.

To achieve the same resonant frequency in patch antenna 40, having an artificial dielectric material substrate, as in a conventional patch antenna with a homogeneous substrate, the artificial dielectric substrate is oriented so that the uniaxial axis, that is, the axis of anisotropy (where $\in_x = \in_z \gg \in_y$, for example) is perpendicular to the surfaces of the high dielectric layers (the y axis in FIGS. 4 and 5, i.e. the direction in which the layers are stacked), and is parallel to the surface of the microstrip patch 42.

Antenna 40 can be, for example, a low weight UHF (240–320 MHz) patch antenna. For purposes of comparison, a conventional patch antenna for this application would include, for example, a homogeneous ceramic slab (8"×8"×1.6") of material PD-13 from Pacific Ceramics of Sunnyvale, Calif. where $\in_r$=13 and the specific gravity is 3.45 grams/cm$^3$. The weight of the homogeneous substrate having the required dimensions would thus be about 12.75 lbs. In the lightweight substrate design of U.S. Pat. No. 6,075,485, layer 12 of substrate 10 can be, for example, a 0.020" thick FSS (such as part no. CD-800 of Atlantic Aerospace Electronics Corp., Greenbelt, Md. for example) designed to represent an equivalent capacitance of at least 300 for the x and z directions of FIG. 1. This FSS is made from one 0.020" thick layer of FR4 fiberglass whose specific gravity is approximately 2.5 grams/cm$^3$. To achieve an effective relative permittivity of $\in_x=\in_z=13\in_0$, layer 14 can be, for example, a 0.500" thick Rohacell foam of the same type used in the example above. Substrate 10 having these design parameters weighs approximately 6.5 oz., which represents a 97% weight reduction from the conventional homogeneous substrate for this antenna application.

For fixed-frequency UHF applications as described above, patch 42 of FIG. 4 can be a six inch square patch (L=6") printed on a 8"×8"×0.060" thick Rogers R04003 printed circuit board (not shown). The circuit board is mounted face down so that patch 42 touches the ceramic slabs of the artificial dielectric substrate 10. The fixed frequency patch antenna 40 built according to these specifications resonates near 274 MHz with a clean single mode resonance. Radiation efficiency, as measured with a Wheeler Cap, is 82.2% (−0.853 dB). Swept gain at boresight, and E-plane and H-plane gain patterns, also compare very similarly to the same patch with a homogeneous substrate. However, as shown above, the fixed frequency patch antenna having artificial dielectric substrate 10 weighs about 97% less than the patch antenna having a conventional homogeneous substrate.

U.S. Pat. No. 6,075,485 achieved remarkable weight and size reductions for a higher frequency antenna, which is desirable for many applications such as autos, aircraft and spacecraft. However, even further benefits may be desired that are not provided solely thereby.

For example, U.S. Pat. No. 6,075,485 taught that a tunable patch antenna such as that described in U.S. Pat. No. 5,777,581 could be used with the artificial dielectric substrate to provide a small, lightweight antenna capable of tuning over the military fleet SATCOM band: 240 MHz to 320 MHz, a tuning ratio of 1.33:1. Such antennas use PIN diodes to expand or contract the effective electrical size of a cavity-backed patch antenna. However, further development work has not been able to extend the tuning ratio beyond about 1.5:1. It would be desirable to find a way to electronically tune a conformal UHF antenna over at least a 2:1 bandwidth, so as to be usable for the 225–400 MHz military communications bands.

Further, some previous tunable patch antennas have incorporated varactor diodes into their substrate for the purpose of tuning. However, the tuning bandwidth is directly related to the ratio of the amount of electric energy stored in the tuning diode(s) to the amount of energy stored in the antenna's substrate. As the substrate dielectric constant is increased in a patch antenna, the antenna's physical size is reduced, but so is the tuning range. No varactor tuned microstrip patch antennas are known where a high substrate permittivity ($\in_r>10$) has been employed with both 1) an electrically small element (i.e. patch length $L<\lambda/4$ where $\lambda$ is the free space wavelength), and 2) a broadband tunable element with an octave or more of tuning range.

Another challenge for the antenna designer is to create a tunable antenna capable of handling medium to high power levels of 30 watts average power or more. For instance, the UHF fleet SATCOM radio systems can provide up to 135 Watts average power upon transmit in the 290 MHz to 320 MHz band. Varactor tuned patch antennas have historically been low power handling elements since the RF voltage applied across the diode causes harmonic distortion at sufficiently high voltages. This is because previous designs used one diode in a shunt circuit between the patch and ground. Accordingly, a design is needed that minimizes the RF voltage drop across any one diode.

Still further, a major limitation of high power-handling tunable antennas is the need for significant control power. State-of the-art tunable antennas which handle CW power of up to 30 watts use PIN diodes which must be forward biased with typical currents of 10 to 100 mA. The tunable patch antenna disclosed in U.S. Pat. No. 5,777,581, for example, consumes between 3 and 10 watts of DC control power depending on the tuning state. It would be very advantageous to develop an alternative tunable antenna technology which uses much less control power.

SUMMARY OF THE INVENTION

The present invention is related to a tunable artificial dielectric material that achieves the weight reductions made possible in U.S. Pat. No. 6,075,485 and further achieves even higher resonant frequency tuning ratios. In one embodiment of the invention, the artificial dielectric substrate for a patch antenna comprises alternating low and high permittivity layers, with the high permittivity layers each comprised of printed capacitive Frequency Selective Surface (FSS). The FSS of the invention has a voltage tunable effective sheet capacitance by virtue of varactor diodes integrated into each unit cell. By appropriate adjustment of the bias voltage across the varactor diodes, the amount of the electric field stored in the substrate can be varied, which further varies the resonant frequency of the patch antenna.

The present invention is particularly useful for UHF fleet SATCOM applications where a light weight and physically small (8" sq. aperture) conformal aperture is desired as a mobile platform such as a military ground vehicle, fighter aircraft, or helicopter. Since the tuning bandwidth approaches one octave in this invention, 225 MHz to 400 MHz military UHF line-of-sight (LOS) communications applications are possible.

BRIEF DESCRIPTION OF THE DRAWINGS

These and other objects and advantages of the present invention will become apparent to those skilled in the art after considering the following detailed specification, together with the accompanying drawings wherein:

FIG. 7 illustrates a conventional linearly-polarized patch antenna;

FIGS. 8 and 9 are cross-sectional side views of the antenna in FIG. 7 taken along sectional lines 8—8 and 9—9, respectively;

FIG. 22 is a cross-sectional view of the PIFA antenna taken along line 22—22 in FIG. 21;

FIG. 23 is a cross-sectional view of the PIFA antenna taken along line 23—23 in FIG. 21;

FIG. 25 is a cross-sectional view of the PIFA antenna taken along line 25—25 in FIG. 24.

DETAILED DESCRIPTION OF THE PREFERRED EMBODIMENTS

Figure 1:
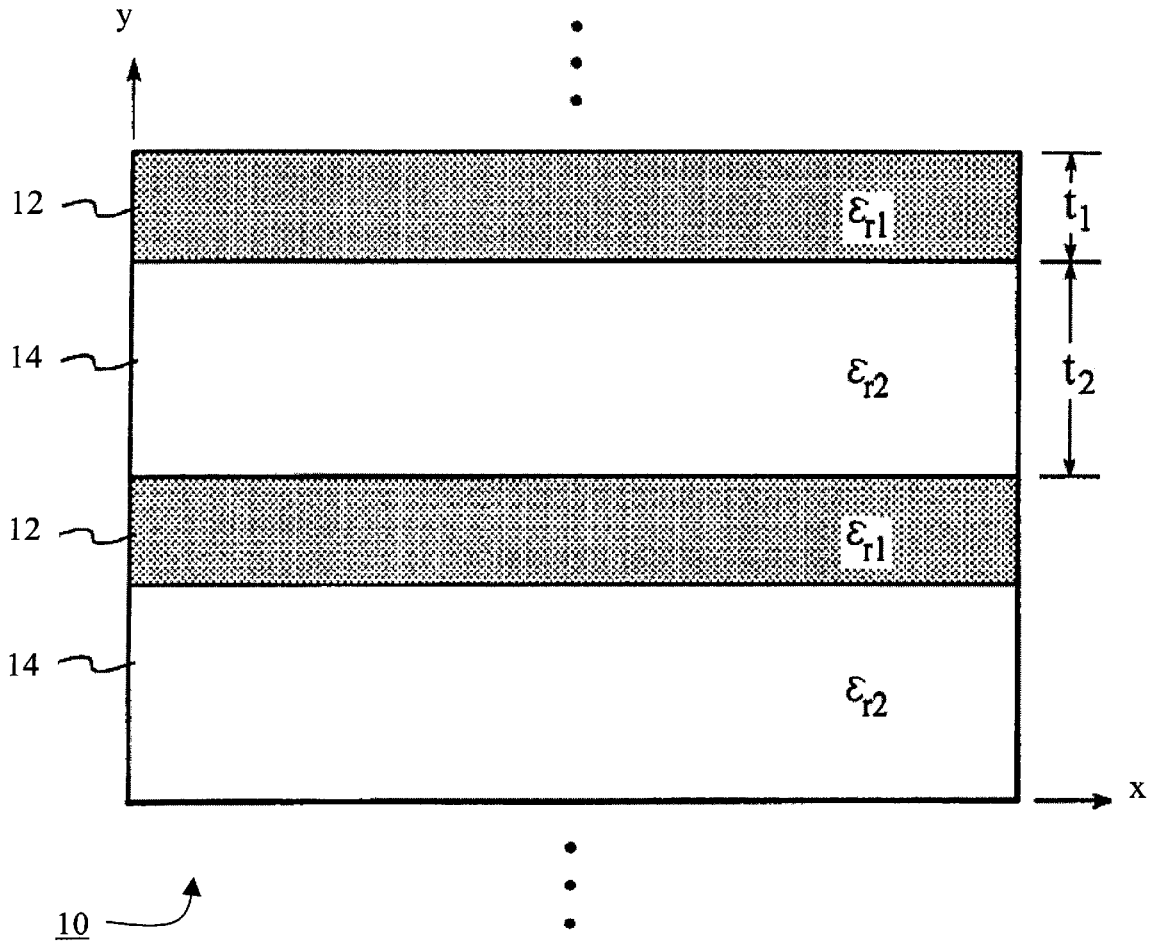
FIG. 1 (PRIOR ART)
FIG. 1 illustrates a layered artificial dielectric material constructed in accordance with the principles of U.S. Pat. No. 6,075,485.
Figure 2:
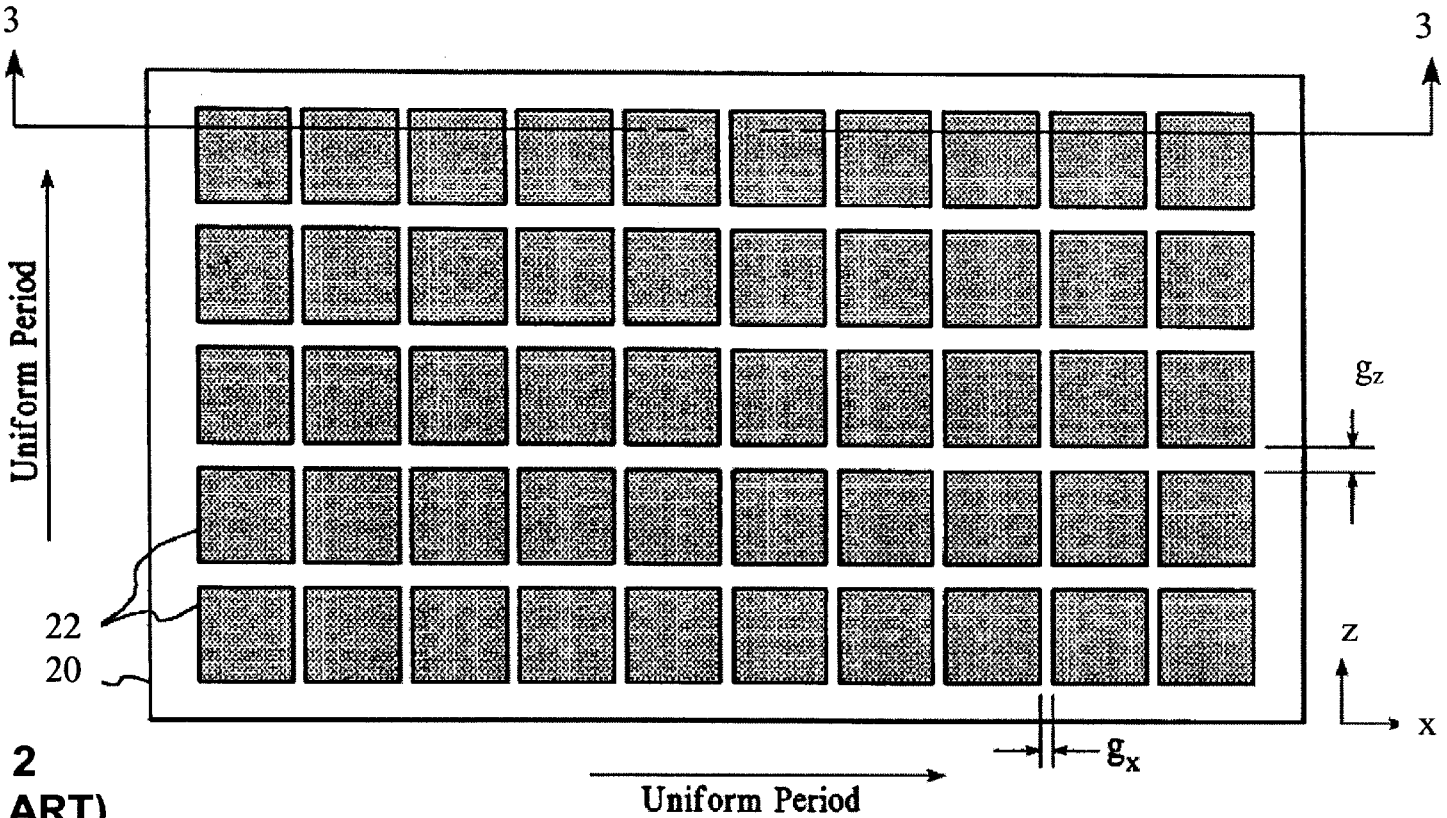
FIG. 2 (PRIOR ART)
FIG. 2 is a top view of one example of a frequency selective surface for use in a layered artificial dielectric material as shown in FIG. 1.
Figure 3:
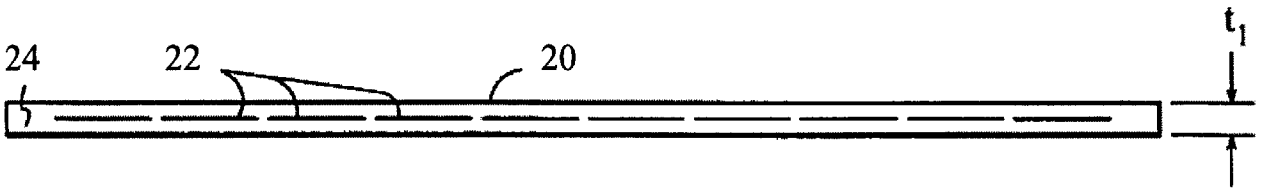
FIG. 3 (PRIOR ART)
FIG. 3 is a side view of the FSS in FIG. 2 taken along sectional line 3—3.

The present invention will now be described in detail with reference to the drawings, which are provided as illustrative examples of the invention so as to enable those skilled in the art to practice the invention. Notably, where certain elements of the present invention can be partially or fully implemented using known components, only those portions of such known components that are necessary for an understanding of the present invention will be described, and detailed descriptions of other portions of such known components will be omitted so as not to obscure the invention. Further, the present invention encompasses present and future known equivalents to the known components referred to herein by way of illustration.

To illustrate the example application of the tunable artificial dielectric structure of the present invention to substrates for patch antennas, first consider the conventional linearly-polarized patch antenna 40 illustrated in FIG. 7. FIGS. 8 and 9 are cross-sectional side views of antenna 40 taken along sectional lines 8—8 and 9—9, respectively. As shown, antenna 40 includes a radiating element being a microstrip patch 42, substrate 44 (which can be comprised of artificial dielectric material 10), a metalized ground plane 46 and a coaxial feed 48. FIGS. 8 and 9 illustrate the dominant mode (lowest resonant frequency) electric field lines of patch antenna 40. As illustrated in FIG. 9, patch 42 is resonant in the x direction with a half sinusoidal variation of vertical electric field (standing wave) under the patch. Surface electric current on the patch is predominantly x-directed, whereas the electric field lines in substrate 44 are primarily z-directed (vertical, i.e. perpendicular to the surface of the patch) except at the left and right edges of the patch where a significant x-directed component is observed due to the fringing fields. The patch is said to radiate from the left and right side edges (in FIGS. 7 and 9).

As seen above, the dominant mode for this resonator has an electric (E) field which is primarily z-directed. The present invention therefore recognizes that one way to change the resonant frequency of the antenna is to change the z component of permittivity in the substrate. Further, since the z component of the equivalent relative dielectric constant of a capacitive FSS is given as $\in_r = C_z/(\in_0 t_1)$ where $\in_0$ is the permittivity of free space and $t_1$ is the thickness the present invention determines that a FSS structure can be employed in the substrate so as to provide a variable sheet capacitance in the z direction, and thus a tunable resonant frequency for the resonator. Although the invention will be described hereinbelow with reference to a particularly useful example where the resonator is a patch antenna, the invention is not limited to this example. Rather, it should be apparent that the principles of the invention can be extended to a broader class of resonators including tunable filters, as well as other types of electromagnetic devices such as microwave lenses. Moreover, although the invention will be described in an example implementation of UHF applications, it should be appreciated that other frequency ranges are possible.

Figure 4:
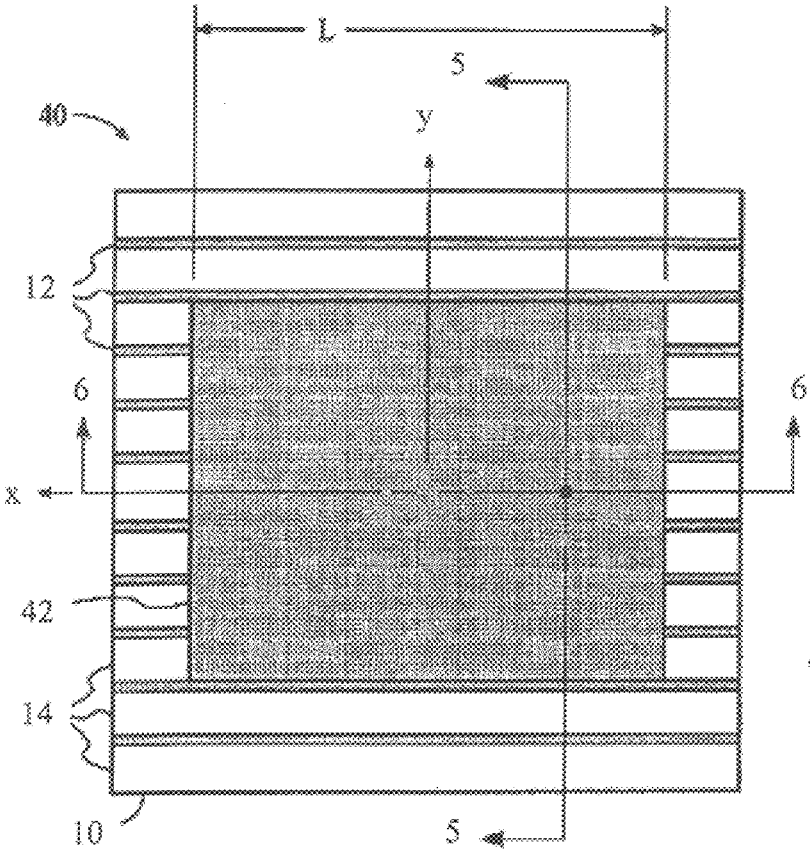
FIG. 4 (PRIOR ART)
FIG. 4 is a top view of a linearly-polarized patch antenna having an artificial dielectric substrate according to U.S. Pat. No. 6,075,485.
Figure 5:
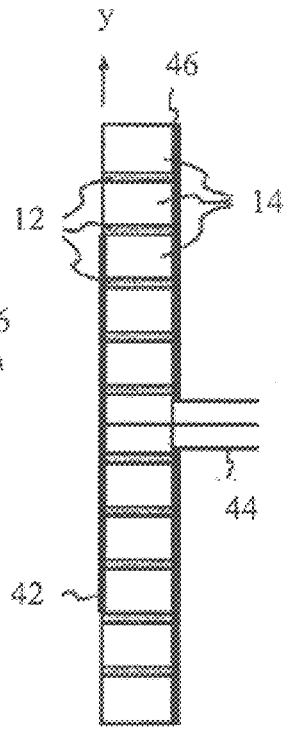
FIG. 5 (PRIOR ART)
FIGS. 5 and 6 are side views of the antenna illustrated in FIG. 4 taken along sectional lines 5—5 and 6—6, respectively.
Figure 6:
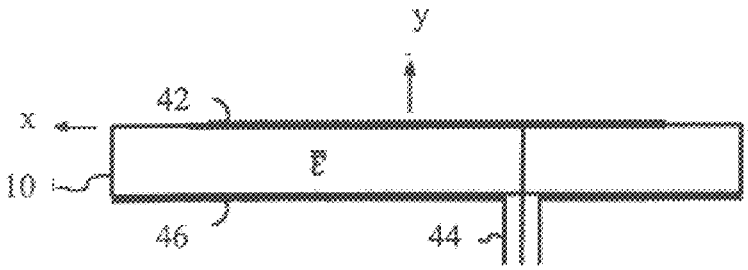
FIG. 6 (PRIOR ART)
Figure 10:
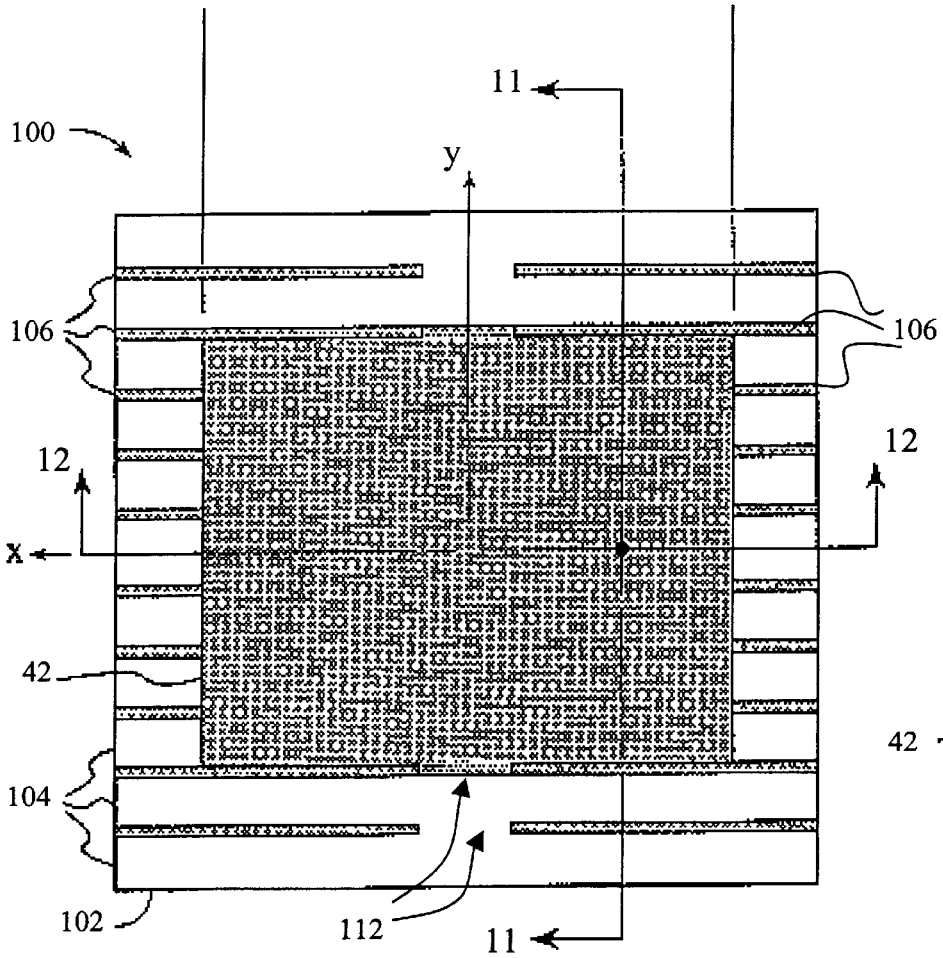
FIG. 10 illustrates a linearly-polarized patch antenna according to the present invention.
Figure 11:
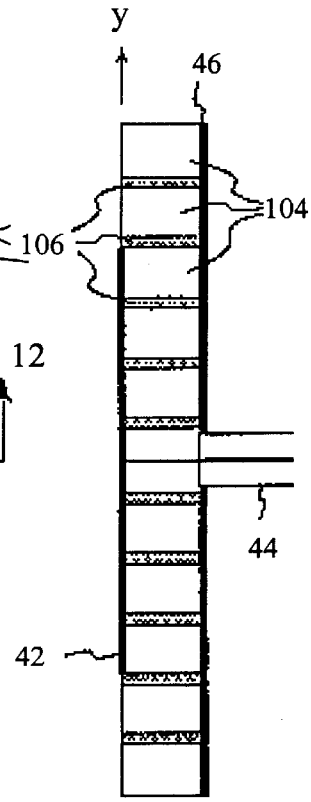
FIGS. 11 and 12 are cross-sectional views of the antenna illustrated in FIG. 10 taken along sectional lines 11—11 and 12—12, respectively.
Figure 12:
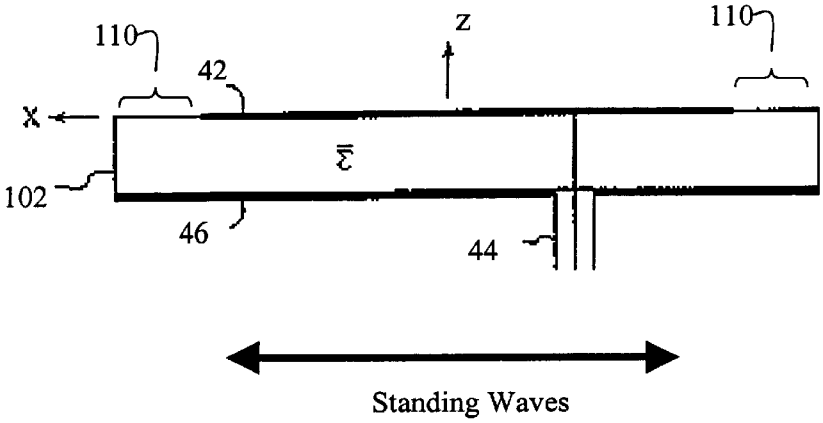

FIGS. 10 through 12 illustrate a linearly-polarized patch antenna 100 according to the invention. FIG. 10 is a top view, and FIGS. 11 and 12 are cross-sectional views taken along lines 11—11 and 12—12, respectively. As shown, antenna 100 is similar in construction to the conventional patch antenna 40 shown in FIGS. 4 through 6 except that the substrate 102 is comprised of a tunable artificial dielectric material having alternating layers 104 and 106 of high and low permittivity dielectric materials, respectively. Specifically, in one example of the invention, the high permittivity dielectric layers 106 can be comprised of an anisotropically-tuned capacitive FSS rather than the fixed-permittivity FSS in the antenna 40. The low permittivity dielectric layers 104 can be comprised of very lightweight materials, for example, air or foam. This provides weight-saving and cost-saving advantages while not substantially lowering the relative permittivity of the entire structure, as will be apparent from the equation set forth below. Substrate 102 is similar to the substrate in conventional patch antenna 40 in that it has an anisotropic permittivity tensor with three components $\in_x$, $\in_y$ and $\in_z$, at least one of which has a different value than the other two (i.e. two of the components may have similar values or all three may have different values).

Antenna 100 can be, in a UHF application example, an 8" square aperture with a ½" diameter copper center post (not shown). Patch 42 is implemented by, for example, printing a 5" square patch (i.e. L=5", $L<\lambda/4$, where $\lambda$ corresponds to the free-space wavelength of a desired resonant frequency or range of the patch) onto a 60 mil thick R04003 substrate and facing the printed side into abutment with layers 104 and 106. Nylon bolts (not shown) can be used to hold down the substrate so as to bring the patch 42 into ohmic contact to the top edges of the layers 106. This arrangement further provides for radiating slots 110 on either side of the patch 42 in the x direction of the aperture.

As can be further seen from FIG. 10, substrate 102 also differs from conventional antenna 40 by including voids 112 created by gaps in the high permittivity dielectric layers 106. In the example provided above, the gaps can be about 2" and can be filled with air or foam. Voids 112 are designed by recognizing from FIG. 9 that the magnitude of the E field in positions below the center of the patch 42 in the x-direction is relatively insubstantial (in accordance with a threshold value determined by design). Accordingly, the marginal benefit of providing tunable dielectric material in these central regions of the antenna is substantially outweighed by other factors such as cost and weight. It should be noted, however, that the invention is not limited to this example, and that high permittivity layers that extend continuously beneath the patch 42 can also be provided.

It should be further noted that voids 112 illustrated in FIG. 10 actually implement a step function, which is a special case of a broader example of this aspect of the invention. In other words, the amount of tunable dielectric material may be graded or varied with respect to a position below the patch in accordance with or proportional to the magnitude of the E field. For example, rather than providing gaps in the high permittivity layers 106, the layers 106 may be implemented as backer boards or unpopulated cards on which variable amounts of tunable dielectric material is provided. The variable amounts may be graded by position relative to the patch in accordance with the magnitude of the E field at that position.

Still further, it should be noted that the amount of tunable dielectric material may be graded in more than one direction, depending on the more dominant directions of the E field (e.g. in a dual linearly polarized antenna).

As set forth above, substrate 102 differs from the substrate in the conventional antenna 40 by providing anisotropically tuned capacitive FSS layers 106. Layers 106 are designed so that the sheet capacitance in the z direction, $C_z$, is very large but tunable, whereas the sheet capacitances in the x and y directions are much lower by typically two or more orders of magnitude. The effective relative permittivity of the layers 106 is thus given as $\in_{eff_FSS}=C_z/(\in_0 t_1)$, where $\in_0$ is the permittivity of free space, and $t_1$ is the thickness of the FSS. The z component of the entire substrate's effective relative permittivity can thus be approximated as $$\varepsilon_z = \frac{\varepsilon_{\text{eff_FSS}} t_1 + t_2}{t_1 + t_2}$$

where $t_2$ is the separation distance between layers 106, and the relative permittivity of the layers 104 is assumed to be 1.0 (which is the case for air). The present invention aims at adjusting the resonant frequency of the antenna 100 by adjusting the sheet capacitance of the layers 106, and thus, the z component of the substrate's effective relative permittivity.

Figure 13:
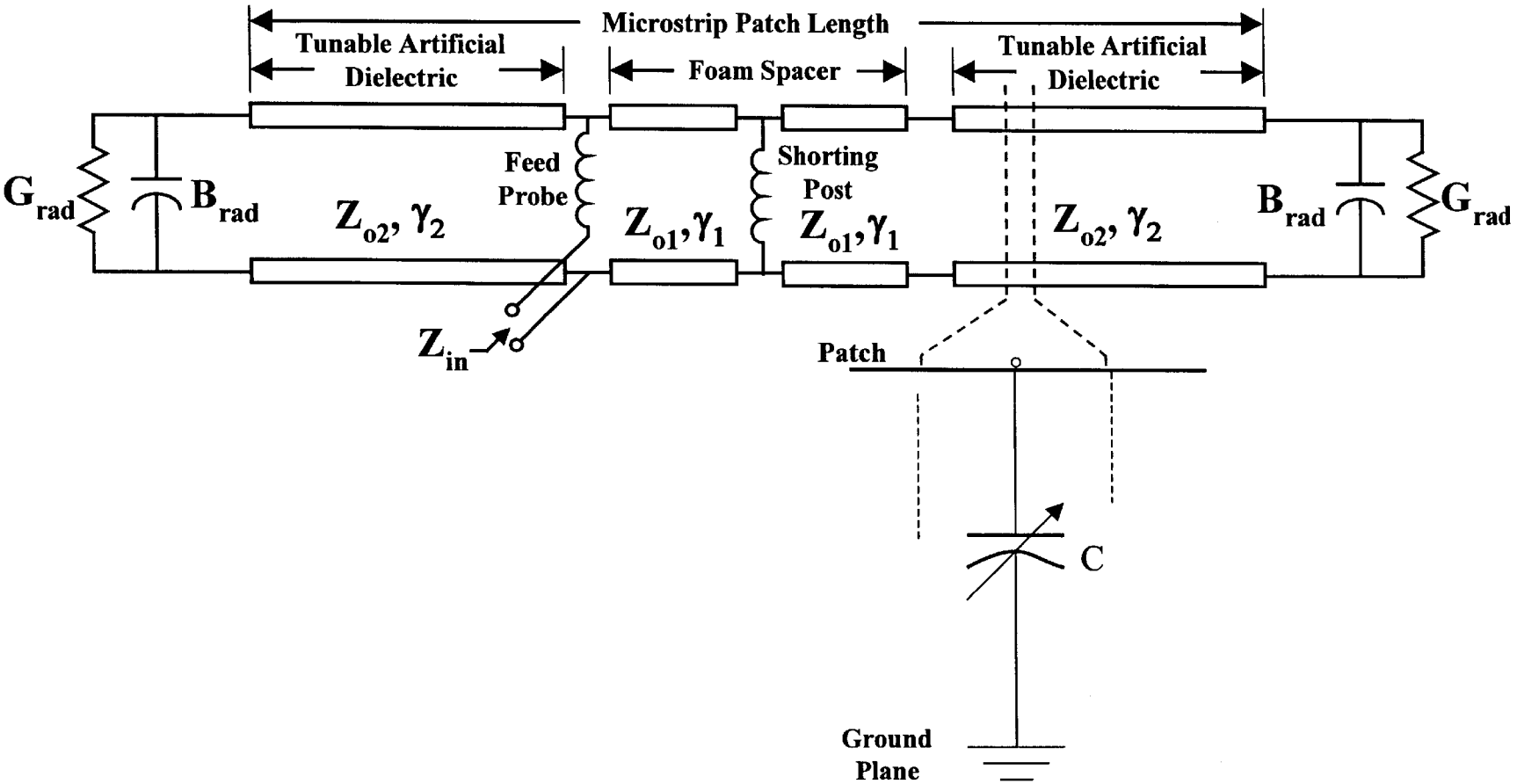
FIG. 13 is an equivalent circuit for a single linearly-polarized aperture antenna such as that shown in FIGS. 10 through 12.

FIG. 13 is an equivalent circuit for a single linearly-polarized aperture antenna such as antenna 100 shown in FIGS. 10 through 12. The various transmission line sections represent the different regions across the x-direction of the antenna 100. In accordance with the present invention, the resonant frequency of the antenna is tuned by varying the characteristic impedance $Z_{02}$ and the propagation constant $\beta$ in the regions corresponding to the layers 106. This is achieved by varying the FSS sheet capacitance C in the z direction between the patch 42 and the ground plane 46 as shown by the following relationships:

$$Z_{02}=\text{sqrt}(L/C)$$

$$\gamma=j\beta=\omega\text{sqrt}(LC)$$

Figure 14:
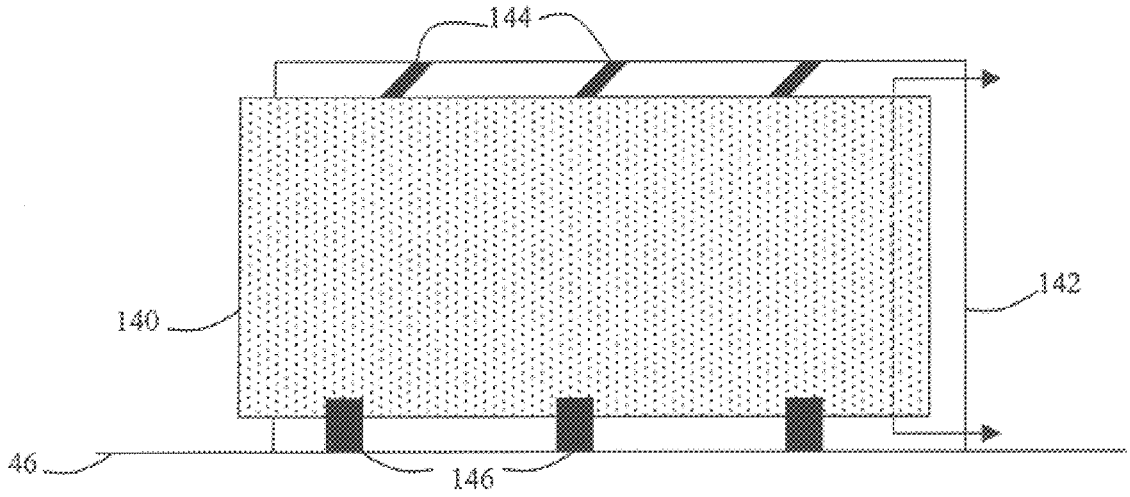
FIG. 14 illustrates one example of a FSS that can be used to implement a high permittivity layer of a tunable artificial dielectric substrate in accordance with one embodiment of the invention.
Figure 15:
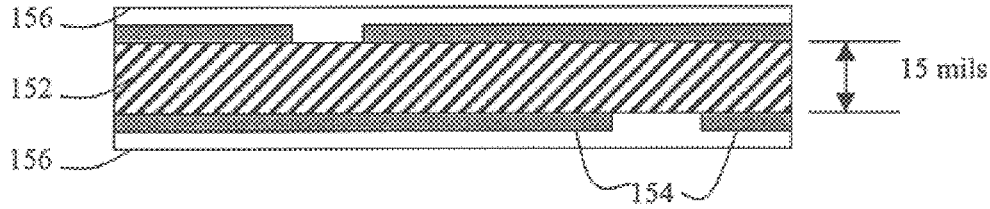
FIG. 15 is a cross-sectional view of the FSS shown in FIG. 14 taken along sectional line 15—15.

FIGS. 14 and 15 illustrate one example of a FSS 140 that can be used to implement layer 106 in accordance with one embodiment of the invention. FIG. 15 is a cross-sectional view of FSS 140 taken along sectional line 15—15.

In this example of the invention, FSS 140 is comprised of a ferroelectric material such as a Barium Strontium Titanate Oxide (BSTO) composite slab with dimensions on the order of about 1.5" by 3" by 0.025". The slab is mounted onto a backer-board 142 with metallic top clips 144 and bottom clips 146 which both hold the slab in place and provide biasing paths. The backer-board is in turn mounted on the bottom of the cavity (e.g. ground plane 46) of the aperture antenna.

FIG. 15 illustrates a cross section of slab 144. As shown in FIG. 15, the slab comprises a core of about 15 mil thick BSTO material 152 surrounded by silver ink 154 and resistive film 156.

When voltage is applied across slab 144, the relative permittivity of the BSTO material changes, thus changing the amount of electric field that can be stored therein, and further changing the resonant frequency of the antenna.

The use of BSTO components, although one possible implementation of layers 106, has several currently observed drawbacks as compared to other possible implementations that are discussed below. First, the in-plane permittivity of BSTO slabs may not be effectively controlled with an out-of-plane component, or normal component, of a biasing electric field. However, most possible biasing schemes offer a dominant biasing electric field component in the normal direction only. Second, BSTO materials exhibit a relatively high loss tangent. Whereas loss tangents lower than 0.001 in the UHF band of interest (i.e. 200 MHz to 400 MHz) are preferred, loss tangents for BSTO materials fall typically an order of magnitude higher than this goal. Third, BSTO material permittivity is not only a function of voltage, but it could also be a stronger function of temperature. This means that some sort of temperature control might be needed for many useful applications. Finally, BSTO components often crack during firing, especially highly tunable BSTO materials, which are of greatest interest.

Figure 16:
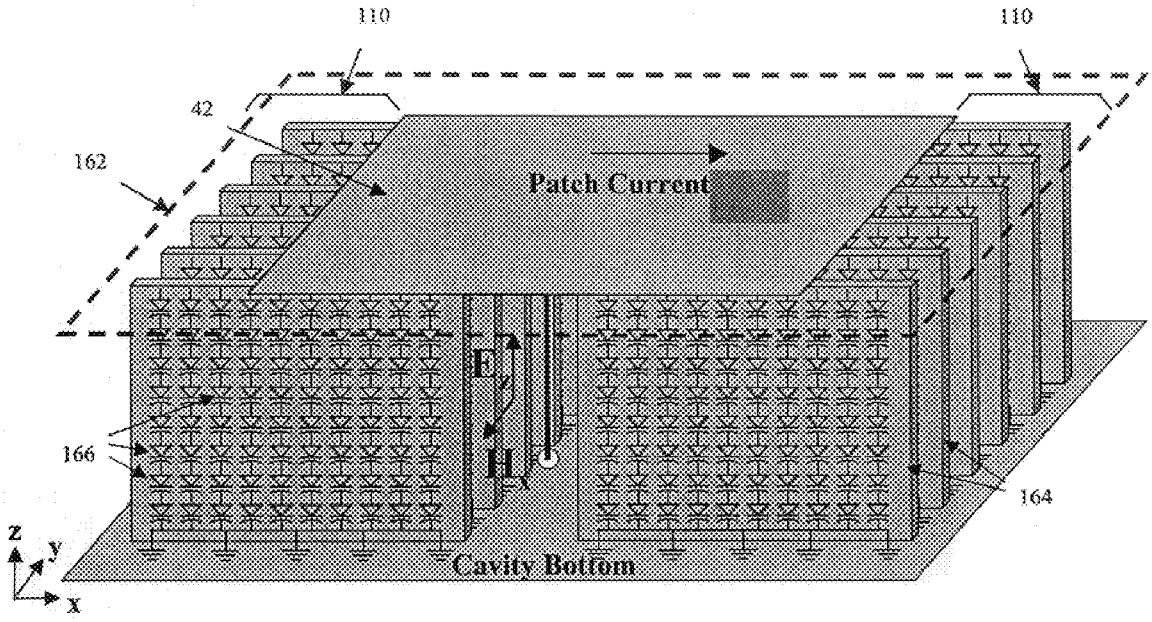
FIG. 16 is a perspective drawing of an antenna including another example of a FSS that can be used to implement the high permittivity layers in accordance with a second embodiment of the present invention.

FIG. 16 is a perspective drawing of antenna 100 including another example of a FSS that can be used to implement layers 106 in accordance with a second embodiment of the present invention. Generally, in this example of the invention, the z-component of the electric field through the substrate is stored at the junctions of diodes, rather than in a unified slab of ferroelectric material. The amount of electric field stored can thus be electrically controlled by manipulating the reverse bias voltage of the diodes.

As shown in FIG. 16, antenna 100 is comprised of, for one example implementation useful for military communications bands (e.g. 225–400 MHz) frequency band applications, a cavity having an 8" by 8" aperture 162 that includes twelve FSS cards 164, each 1.5" tall, 3.0" long, and 0.060" thick, and equally spaced on 0.5" centers ($t_1$=0.060", $t_2$=0.430"). The FSS cards can be captured at the cavity bottom (e.g. metalized ground plane 46) by sliding them between two rows of BeCu spring finger stock (not shown). The ends of the cards slip into grooves, or card guides, milled into the cavity wall (not shown). The bottom of the cavity can include a stripline printed circuit board with a bias line routed internally. The cavity is probe fed with the center conductor of the coaxial feed 44 extending up through the cavity and being soldered to the patch 42. The probe feed is centered between the middle two FSS cards 164.

As further shown in FIG. 16, mounted on both sides of each side of FSS cards 164 are diode strings 166. FSS cards 164 can be comprised of, for example, 60 mil thick Rogers R04003 substrate material. In this example of the invention, the strings 166 are equally spaced 0.15" on center. Strings on the back side are offset one half of a cell width (0.075") in the x direction so as to be disposed opposite to the spaces between the strings on the front side.

Figure 17:
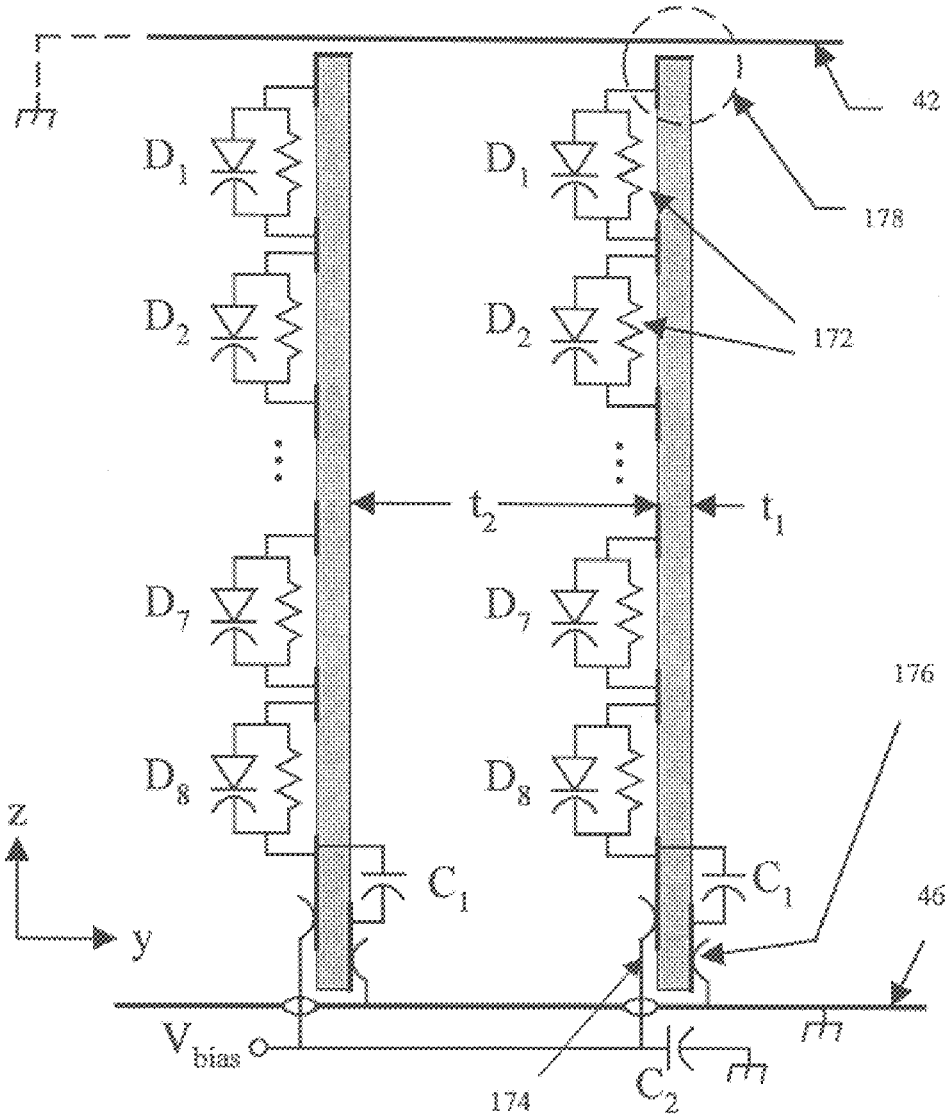
FIG. 17 is a side view of two adjacent FSS cards, as well as a circuit diagram for a varactor-tuned FSS cards such as that illustrated in FIG. 16.

FIG. 17 is an example side view of two adjacent FSS cards 164, as well as a circuit diagram for the varactor-tuned FSS cards 164 as illustrated in FIG. 16.

As shown in FIG. 17, each diode string 166 in this example includes eight varactor diodes $D_1$ to $D_8$ (e.g. Alpha Industries P/N SMV1411-001) connected in series. Placed in parallel with each diode is a 2.2 MΩ ballast resistor 172, so as to equalize the reverse bias voltage for all eight diodes in the string. Every diode string 166 in the antenna is biased through BeCu fingers 174 using the same potential, Vbias, which has a range of 0 to 240 volts so that each individual diode is biased at a maximum reverse potential of 30 volts. The top end of each diode string is held at ground potential since the circuit makes ohmic contact 178 with the patch 42. Chip capacitors $C_1$ (100 pF, 300 WVDC) are RF bypass caps used to short the bottom end of each diode string to the cavity bottom through opposing BeCu fingers 176.

In one experiment of a resonator fabricated in accordance with this example, the resonant frequency was tuned from 176 MHz at $V_{bias}$=0 volts to 327 MHz at $V_{bias}$=240 volts. This yields a tuning ratio of 1.85:1. It should be noted that continuous analog tuning control is one advantageous feature of this design. It should be further noted that a FSS card 164 fabricated in accordance with this example of the invention weighs only ½ oz., so all twelve of the FSS cards shown in FIG. 16 weigh only a combined 6 oz.

In the above-described experiment, the current drain from the biasing power supply was less than 1 mA at 240 volts, which is a maximum control power of 240 mW. This current drain included the reverse bias leakage current flowing through the dozens of diode strings (19 strings/card×6 cards). From this it can be appreciated that the tunable artificial dielectric concept of the present invention is an enabling technology for battery power applications.

Figure 18:
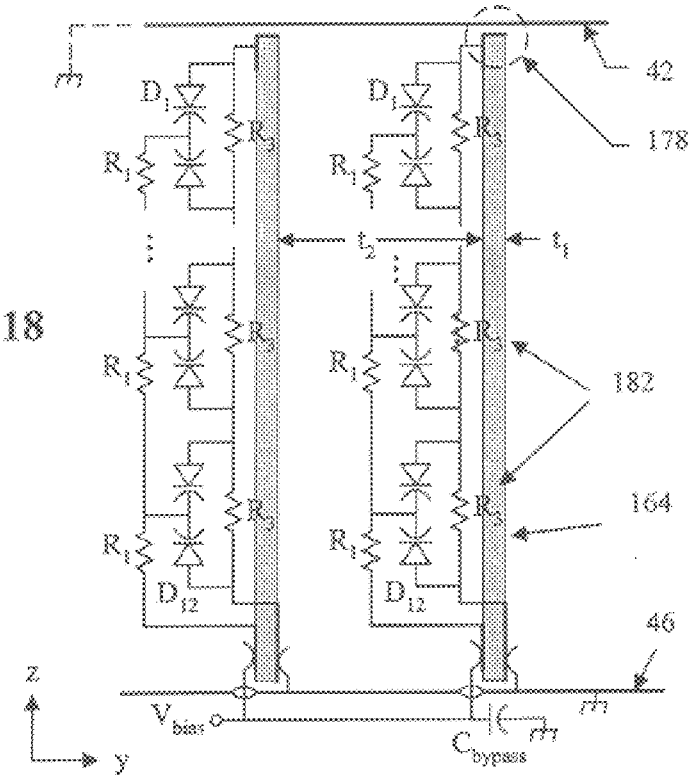
FIG. 18 is a side view of two adjacent FSS cards, as well as a circuit diagram for the diode strings in accordance with a third embodiment of the invention consistent with the antenna illustrated in FIG. 16.
Figure 19:
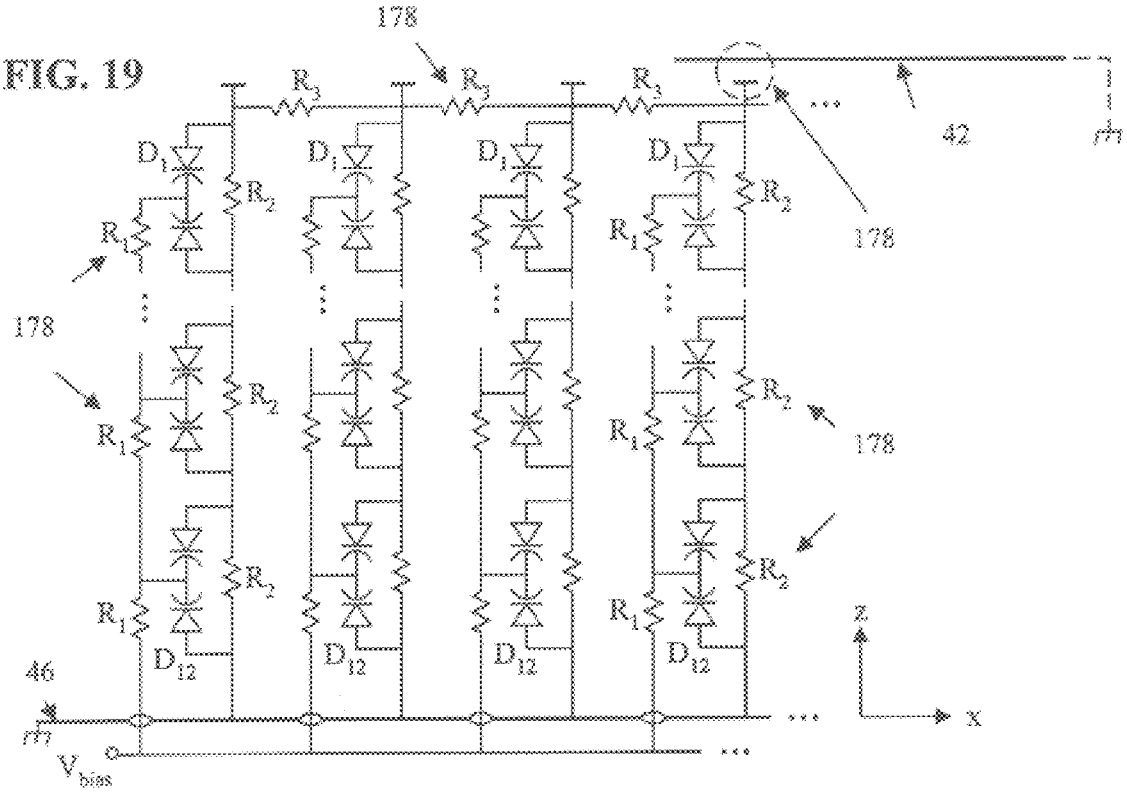
FIG. 19 is a front view of one FSS card in accordance with the embodiment of the invention illustrated in FIG. 18.

FIG. 18 is a side view of two adjacent FSS cards 164, as well as a circuit diagram for the diode strings 166 in accordance with a third embodiment of the invention consistent with the antenna illustrated in FIG. 16. FIG. 19 is a front view of one FSS card 164 in accordance with this embodiment of the invention.

As should be apparent from FIG. 18, one difference between the strings 166 in this example of the invention is that diodes in a given string are biased in parallel and not in series. The RF bypass capacitors are no longer needed at the base of each diode string, since anti-parallel diode pairs are now used where the cathodes can be connected directly to ground. This is advantageous in that such bypass capacitors can comprise one of the most expensive components, as they are typically implemented with high voltage ceramic capacitors. In the circuit design of FIGS. 18 and 19, all of the decoupling is done by chip resistors 182, which currently cost only about $10 per thousand. Furthermore, the cost of the anti-parallel silicon diode pairs is essentially the same as the cost of the single diodes in SOT-23 packages used in the other embodiment. Thus, the diode cost can be reduced by about 50%. In sum, this FSS design can be implemented at a cost of only about ⅓ of the design shown in FIG. 17. In addition, this design uses a maximum bias voltage of only 30 volts since all the diode strings 166 are biased in parallel. This further reduces the cost and complexity of the bias control circuit.

As shown in FIGS. 18 and 19, the design in this example of the invention of FSS 164 uses twelve diodes per string, packaged in six SOT-23 plastic packages. An abrupt junction silicon tuning diode, such as part number MA45436 from MACOM, for example, is used. Decoupling resistors $R_1$ and $R_2$ have a resistance of, for example, 2.2 MΩ, and $R_3$ is, for example, 50 KΩ in resistance. The anodes for all diodes are held near the potential $V_{bias}$ by virtue of the biasing networks comprised of resistors $R_1$. The cathodes of all diodes are held near ground potential by virtue of the biasing networks comprised of resistors with values $R_2$ and $R_3$.

Even further advantages using this example of the invention are possible. For example, using the silicon varactor diodes specified above, radiation efficiency drops below 3 dB for bias voltage levels below 5 volts in certain applications. This is primarily due to the increased RF losses in the silicon varactor diodes at low bias levels. Another way to understand this is that the Q of the varactor diodes drops at low bias voltages, which in turn raises the effective loss tangent of the tunable FSS cards. There may be at least two ways to mitigate this low efficiency problem.

First, for example, the FSS cards may be implemented using higher Q diodes, which can be GaAs tuning diodes. However, there is an engineering trade-off between the Q of a varactor tuning diode and its ratio of maximum to minimum capacitance. Accordingly, a GaAs diode can be chosen that has about the same Q as the previous silicon diode, but achieves a higher capacitance ratio, near 10:1. This may be done by using a MACOM MA46H203 abrupt junction diode, which has an advertised minimum Q of 1500 at 4 volts reverse bias. A tuning range of 2.3:1 can be predicted using this type of diode, which is an improvement in tuning bandwidth over the silicon varactor diode.

GaAs tuning diodes are believed to offer several other advantages over silicon diodes in the tunable artificial dielectric aperture in accordance with the present invention. Not only are GaAs diodes able to have a larger capacitance ratio for the same Q, but they are believed to cause less harmonic distortion because the semiconductor bandgap in GaAs is larger. However, one potential drawback with this alternative design is that GaAS diodes are currently about 8 to 20 times more expensive than single silicon diodes in a SOT-23 plastic package.

The second way to mitigate the above-described RF losses that lower radiation efficiency is to modify the biasing networks so that the chains of bias decoupling resistors are not collinear with the direction of the RF electric field in the cavity.

Figure 20:
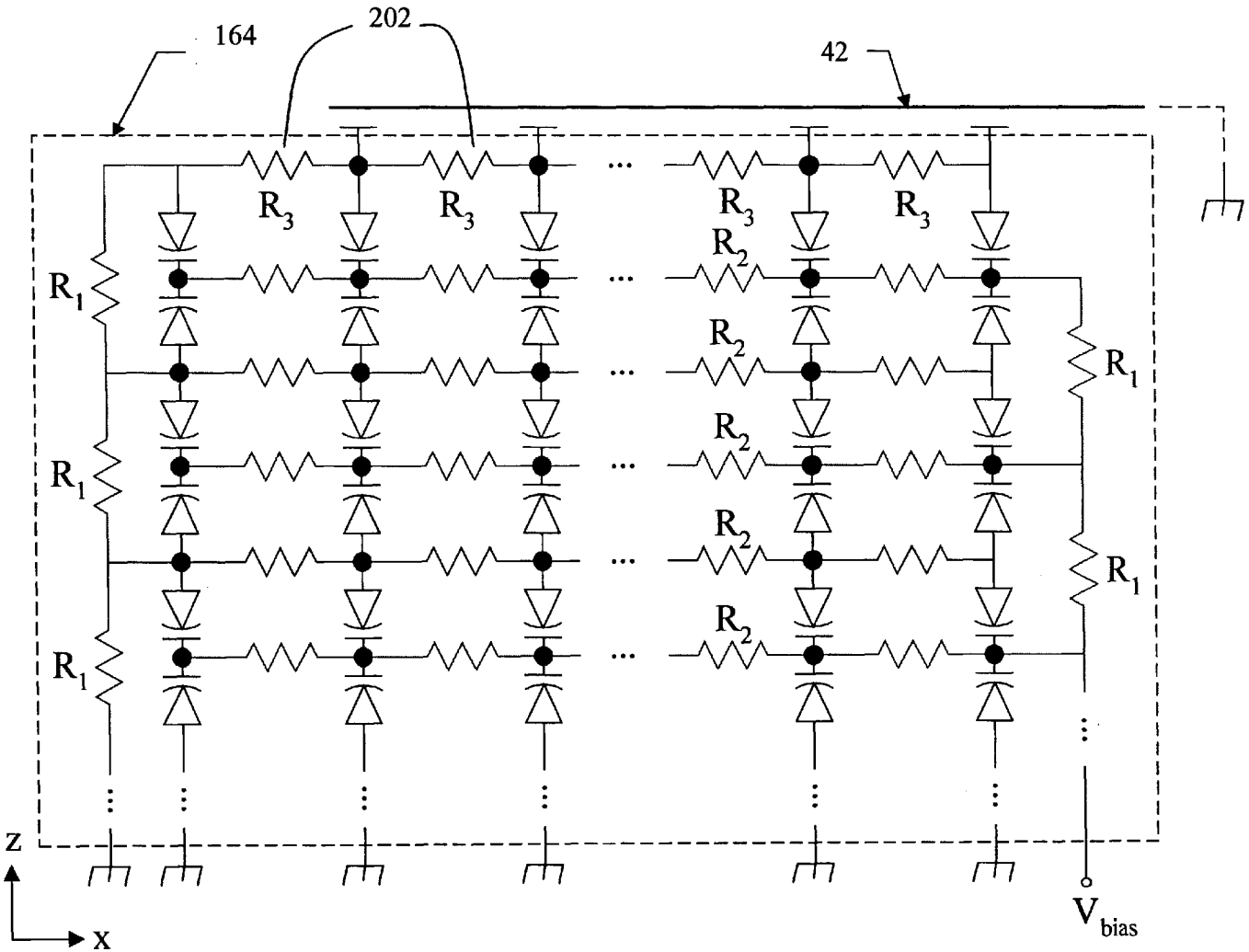
FIG. 20 illustrates an alternative biasing circuit according to yet another example of the invention.

An alternative biasing circuit according to yet another example of the invention is shown in FIG. 20. As can be seen, it differs from previous circuits in that ground and biasing potentials are distributed by rows of decoupling resistors 202 to the interior of the diode array rather than along columns. This eliminates the need for resistor networks connecting nodes that are aligned in the z direction, collinear with the RF electric field. The reason that it may be desirable to avoid z-directed resistive networks is to avoid placing shunt resistances in parallel with the diodes and creating undesired parasitic losses. The net result is that this biasing circuit is believed to offer a lower effective loss tangent for the FSS than the biasing designs shown in FIGS. 17 and 18. Suggested values for biasing resistors are R1=R2=2.2 MΩ, R3=50 KΩ.

It is important that the bias decoupling resistors have a minimum of parasitic capacitance, so as to have minimum impact on restricting the sheet capacitance ratio of the tunable FSS. For this reason, it may be desirable to use 1/10 watt, 0805 case size, thick film chip resistors. They are estimated to have a shunt capacitance of about 0.05 pF.

It should be noted that the principles of the invention are easily extendable to dual linearly polarized apertures as well as single polarized apertures. For example, FSS cards 164 such as those described above can be used to implement the high permittivity layers in the dual linearly polarized apertures described in U.S. Pat. No. 6,075,485. In such an example of the invention, the high permittivity layers (i.e. the high permittivity directions of anisotropy of the artificial dielectric material) thus extend in two directions corresponding to the dual directions of the dominant electric field of the patch. A tuning ratio of 1.62:1 is observed as the resonant frequency tunes from 221 MHz to near 358 MHz in this alternative embodiment of the invention, with only one feed probe installed.

It should be further noted that there may exist even further ways to improve the tunable artificial dielectric performance beyond that described above. One option is to use variable capacitance MEMS to replace the varactor diodes. Variable capacitors have been reported which operate at discrete values by combining ohmic contact MEMS RF switches and fixed capacitors. Other analog types of MEMS capacitors have been reported where the capacitance is continuously adjustable. Even higher tuning ratios may be achieved as MEMS capacitance ratios of 100:1 have been reported. Also, MEMS devices are expected to be more linear, and hence may have more potential for high power transmit applications than varactor diodes. MEMS devices are also expected to have higher Q values than varactor diodes. MEMS devices may be the technology path to an efficient 150 Watt, lightweight, conformal SATCOM antenna in accordance with the invention that uses only milliwatts of prime power for control.

The antennas of the above-described embodiments have been generally described with reference to one possible implementation in cavity-backed patch antennas, either one-quarter or one-half of a guide in wavelength in length from side to side inside the cavity. However, it should be noted that various other implementations in accordance with the invention are possible.

Figure 21:
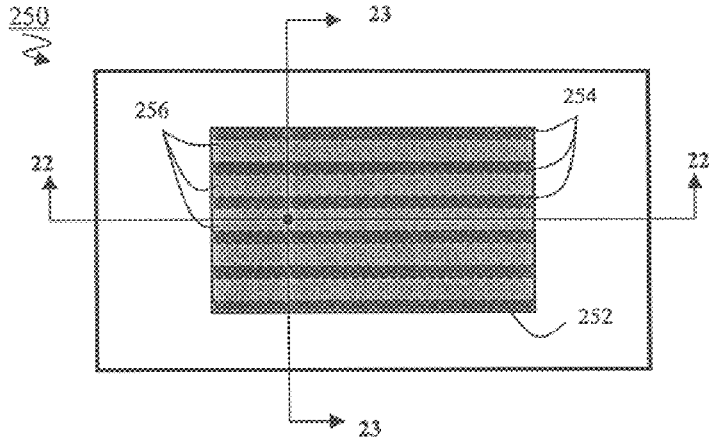
FIGS. 21 to 23 illustrate a PIFA antenna in accordance with another embodiment of the invention.
Figure 23:
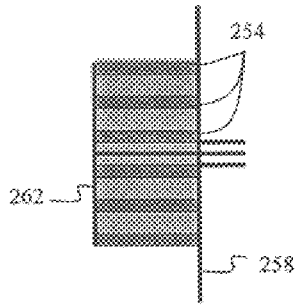
Figure 22:
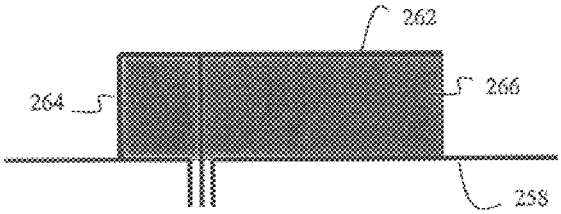

FIGS. 21 to 23 illustrate an antenna 250 in accordance with another embodiment of the invention. As shown in these drawings, antenna 250 is implemented without a cavity and simply as a shorted microstrip patch above a ground plane, such as a planar inverted F antenna (PIFA) or shorted patch antenna.

As shown in FIGS. 21 to 23, PIFA 250 includes a substrate 252 which comprises spaced apart layers of tunable high permittivity layers 254. Spaces between the slabs (or cards) can be air, foam, or any relatively low $\in_r$ material 256. The slabs can be comprised of FSS cards or any of the high permittivity slabs described herein. FIG. 22 is a cross-sectional view of antenna 250 taken along line 22—22 and FIG. 23 is a cross-sectional view taken along line 23—23. The direction of the dominant mode electric field is from ground plane 258 up to microstrip patch (i.e. PIFA lid) 262, and standing waves run the length of the patch 262, between shorting wall 264 and the radiating aperture 266.

Shorting wall 264 can be comprised of a solid conductive material such as copper or tin, or it can be comprised of closely spaced vias. The length of patch 262 in the horizontal direction shown in FIGS. 21 and 22 is preferably about $\lambda_g/4$, where $\lambda_g$ is a guide wavelength. In comparison with an antenna such as that shown in FIG. 16, for example, the distribution of patch current in that antenna undergoes a half cycle across the length of the half-wavelength patch 42 (zero at the left edge to a maximum in the center to zero at the right edge), whereas the current distribution on the quarter-wavelength patch (i.e. PIFA lid) 262 is one quarter of a standing wave (maximum at the left edge and going to a minimum at the right edge). An advantage of the PIFA embodiment, therefore, is that antennas can be made smaller and less costly.

Figure 24:
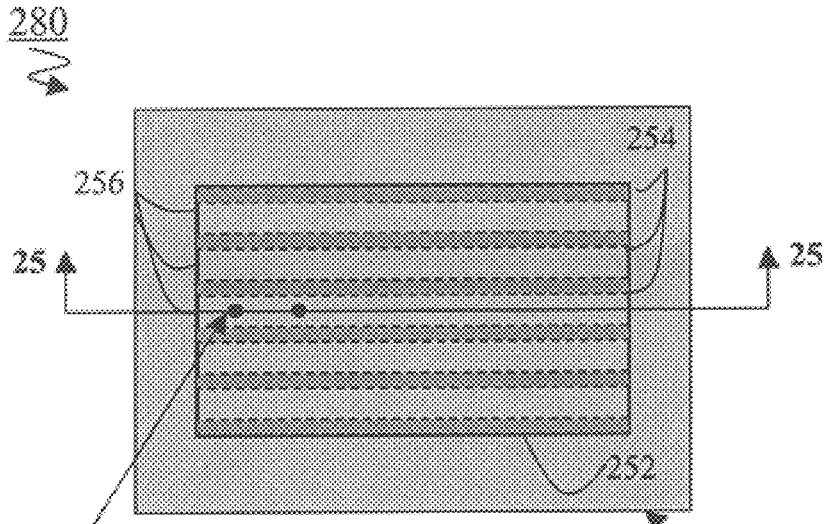
FIGS. 24 and 25 illustrate another embodiment of a PIFA antenna where the shorting wall of FIGS. 21 to 23 has been replaced with a more economical shorting pin.
Figure 25:
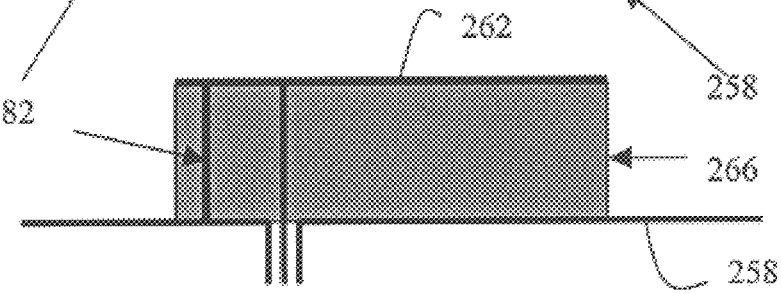

Another embodiment of a PIFA antenna 280 containing a tunable anisotropic artificial dielectric substrate 252 is shown in FIGS. 24 and 25 (which is a cross-sectional view taken along line 25—25) where the shorting wall has been replaced with a more economical shorting pin or via 282. Although the pin 282 has a larger inductance than a shorting wall, the pin may help to improve the impedance match in some designs. It should be noted, furthermore, that multiple shorting pins may be used and that there can be various combinations of locations for feed probes and shorting pins, which are known to those skilled in the art of PIFA design. Notably, the tunable high permittivity slabs are oriented so as to adjustably increase the z component of effective permittivity under the PIFA lid. The benefit of this approach is to reduce the volume occupied by the PIFA by slowing down the phase velocity for waves traveling through the PIFA's substrate.

Although the present invention has been described in detail with reference to the preferred embodiments thereof, those skilled in the art will appreciate that various substitutions and modifications can be made thereto without departing from the inventive concepts set forth herein. For example, although certain layers have been illustrated as evenly spaced and uniformly distributed with material, the invention is not limited to such illustrations, but embraces variations in spacing and distribution. Accordingly, the present invention is not limited to the specific examples described; rather, these and other variations can be made while remaining within the spirit and scope of the invention as defined in the appended claims.

What is claimed is:

1. An artificial dielectric material having an anisotropic permittivity tensor, the artificial dielectric material comprising:

a low permittivity layer; and a high permittivity layer, wherein the high permittivity layer has a tunable relative permittivity in at least one direction of the anisotropic permittivity tensor, and wherein the high permittivity layer is comprised of a frequency selective surface which is comprised of a plurality of strings of diodes, the tunable relative permittivity being provided by adjusting the reverse bias voltages of the diodes and controlling the amount of electric field stored therein.

2. An artificial dielectric material according to claim 1, wherein the low permittivity layer is comprised of a very lightweight material.

3. An artificial dielectric material according to claim 1, wherein the very lightweight material is one of foam and air.

4. An artificial dielectric material according to claim 1, wherein the anisotropic permittivity tensor has one direction of high effective permittivity, the artificial dielectric material being adapted to be provided as a substrate in a resonator, the one direction corresponding to a direction of dominant electric field of the resonator.

5. An artificial dielectric material according to claim 4, wherein the high permittivity layer comprises respective amounts of tunable permittivity material in a plurality of positions of the high permittivity layer, the respective amounts being determined in accordance with respective magnitudes of a dominant mode electric field of the resonator at the plurality of positions.

6. An artificial dielectric material according to claim 1, wherein the anisotropic permittivity tensor has two directions of high effective permittivity, the artificial dielectric material being adapted to be provided as a substrate in a resonator, the two directions corresponding to directions of dominant electric field of the resonator.

7. An artificial dielectric material according to claim 6, wherein the high permittivity layer comprises respective amounts of tunable permittivity material in a plurality of positions of the high permittivity layer, the respective amounts being determined in accordance with respective magnitudes of a dominant mode electric field of the resonator at the plurality of positions.

8. An artificial dielectric material according to claim 1, wherein the low permittivity layer and the high permittivity layer are substantially planar with corresponding thicknesses, the layers being repeated in a periodic fashion with respect to their thicknesses so as to form a stacked periodic structure of the low and high permittivity layers.

9. A frequency selective surface in an anisotropic artificial dielectric material adapted to form the substrate of a resonator, comprising:

a plurality of variable capacitors arranged in the frequency selective surface so as to be coupled between a radiating element and a ground plane of the resonator, a relative permittivity of the artificial dielectric material being tunable by controlling the amount of electric field stored in the variable capacitors.

10. A frequency selective surface according to claim 9, wherein the variable capacitors are comprised of silicon varactor diodes.

11. A frequency selective surface according to claim 9, wherein the variable capacitors are comprised of GaAs tuning diodes.

12. A frequency selective surface according to claim 9, wherein the variable capacitors are comprised of MEMS devices.

13. A frequency selective surface in an anisotropic artificial dielectric material adapted to form the substrate of a resonator, comprising:

a plurality of variable capacitors arranged in the frequency selective surface so as to be coupled between a radiating element and a ground plane of the resonator; and a plurality of bias resistors connected to each other in series, each resistor being connected in parallel to a corresponding one of the plurality of variable capacitors so that a substantially equal reverse bias voltage is provided across each diode by a voltage division between each of the bias resistors.

14. A frequency selective surface according to claim 13, wherein the variable capacitors are comprised of one of silicon varactor diodes, GaAs tuning diodes and MEMS devices.

15. A frequency selective surface in an anisotropic artificial dielectric material adapted to form the substrate of a resonator, comprising:

a plurality of variable capacitors arranged in the frequency selective surface so as to be coupled between a radiating element and a ground plane of the resonator; and a plurality of bias and decoupling resistors connected so as to form two distinct ladder networks, wherein one ladder network is grounded and has nodes which connect to the cathode of each of the variable capacitors, and wherein the second ladder network is held at an intended reverse bias potential for each of the variable capacitors, and has nodes which connect to the anode of each of the variable capacitors.

16. A frequency selective surface according to claim 15, wherein the variable capacitors are comprised of one of silicon varactor diodes, GaAs tuning diodes and MEMS devices.

17. A frequency selective surface in an anisotropic artificial dielectric material adapted to form the substrate of a resonator, comprising:

a plurality of variable capacitors arranged in the frequency selective surface so as to be coupled between a radiating element and a ground plane of the resonator, wherein the plurality of variable capacitors are connected in series in a direction between the radiating element and the ground plane, the direction corresponding to a dominant electric field component of the resonator.

18. A frequency selective surface according to claim 17, wherein the variable capacitors are comprised of one of silicon varactor diodes, GaAs tuning diodes and MEMS devices.

19. A frequency selective surface in an anisotropic artificial dielectric material adapted to form the substrate of a resonator, comprising:

a plurality of variable capacitors arranged in the frequency selective surface so as to be coupled between a radiating element and a ground plane of the resonator, wherein the plurality of variable capacitors are disposed in a respective plurality of positions of the substrate, the respective positions being determined in accordance with respective magnitudes of a dominant mode electric field of the resonator at the plurality of positions.

20. A frequency selective surface according to claim 19, further comprising low permittivity material in portions of the substrate not corresponding to the plurality of positions.

* * * * *